US006507236B1

(12) United States Patent
Enriquez

(10) Patent No.: US 6,507,236 B1
(45) Date of Patent: Jan. 14, 2003

(54) MULTISTAGE PRECISION, LOW INPUT/ OUTPUT OVERHEAD, LOW POWER, HIGH OUTPUT IMPEDANCE AND LOW CROSSTALK CURRENT MIRROR

(75) Inventor: Leonel Ernesto Enriquez, Melbourne Beach, FL (US)

(73) Assignee: Intersil Americas Inc., Irvine, CA (US)

( * ) Notice: Subject to any disclaimer, the term of this patent is extended or adjusted under 35 U.S.C. 154(b) by 0 days.

(21) Appl. No.: 09/901,259

(22) Filed: Jul. 9, 2001

(51) Int. Cl.[7] ..... G05F 1/10
(52) U.S. Cl. ..... 327/538; 323/315
(58) Field of Search ..... 327/538, 542, 327/540; 323/315

(56) References Cited

U.S. PATENT DOCUMENTS 3,813,607 A * 5/1974 Voorman ..... 323/315
4,412,186 A * 10/1983 Nagano ..... 323/316
4,462,005 A * 7/1984 Kusakabe et al. ..... 330/288
5,311,146 A * 5/1994 Brannon et al. ..... 323/315
5,473,243 A * 12/1995 Thomas ..... 323/315
6,087,819 A * 7/2000 Kuroda ..... 323/315

* cited by examiner

*Primary Examiner*—Terry D. Cunningham
(74) *Attorney, Agent, or Firm*—Allen, Dyer, Doppelt, Milbrath & Gilchrist, P.A.

(57) ABSTRACT

To mitigate against base current errors in a current mirror circuit having a low overhead supply voltage, a complementary polarity base current error reduction and auxiliary turn-on circuit provides an overhead voltage that enjoys a base-emitter diode drop improvement over a conventional circuit. The emitter area of an input stage's input current mirror transistor is used as a normalizing factor, and each output stage contains additional current circuitry that compensates for geometry differences of current mirror transistors, minimizing power dissipation and crosstalk. Emitter areas of input stage transistors are defined in accordance with current compensation relationships between the transistor circuits of the output stages and the input stage.

20 Claims, 2 Drawing Sheets

MULTISTAGE PRECISION, LOW INPUT/OUTPUT OVERHEAD, LOW POWER, HIGH OUTPUT IMPEDANCE AND LOW CROSSTALK CURRENT MIRROR

CROSS-REFERENCE TO RELATED APPLICATION

The present invention relates to subject matter disclosed in my co-pending U.S. patent application Ser. No. 09/901,439, filed coincident herewith, entitled: "Mechanism for Minimizing Current Mirror Transistor Base Current Error for Low Overhead Voltage Applications" (hereinafter referred to as the '439 application), assigned to the assignee of the present application and the disclosure of which is incorporated herein.

FIELD OF THE INVENTION

The present invention relates in general to electronic circuits, and is particularly directed to new and improved multistage current mirror circuit architecture, that is configured to minimize transistor base current errors or offsets in a low voltage application such as, but not limited to, the coupling to a low voltage codec of a subscriber line interface circuit, having very high output impedance and minimum crosstalk.

BACKGROUND OF THE INVENTION

System equipments of telecommunication service providers customarily contain what are known as subscriber line interface circuits or 'SLICs', to interface communication signals with the tip and ring leads of a wireline pair used to serve a relatively remote piece of subscriber communication equipment. In order that they may be interfaced with a variety of telecommunication circuits, including those providing codec functionality, present day SLICs must conform with a very demanding set of performance requirements, including accuracy, linearity, insensitivity to common mode signals, low noise, low power consumption, filtering, and ease of impedance matching programmability.

Through the use of differential voltage-based implementations, designers of integrated circuits used for digital communications, such as codecs and the like, are able to lower voltage supply rail requirements for their devices (e.g., from a power supply voltage of five volts down to three volts). As a result, the communication service provider now faces the problem that such low voltage restrictions may not provide sufficient voltage headroom to accommodate a low impedance-interface with existing SLICs (such as those designed to operate at a VCC supply rail of five volts).

This limited voltage headroom problem may be illustrated by considering the design and operation of a conventional current mirror architecture, such as that shown in FIG. 1, which is of the type employed in a subscriber line interface circuit, and operates with a customary VCC supply rail of five volts. In this conventional current mirror design, an input NPN transistor 10 has its base 11 coupled to a voltage reference $V_{REF}$, and its emitter 12 coupled to receive an emitter current $I_{12}$ or input current $I_{in}$, from a digital communication device, such as a codec.

The collector 13 of the input NPN transistor 10 is coupled in common to the collector 23 of a first current mirror input PNP transistor 20, and to the base 31 of a base current compensator PNP transistor 30; the collector 33 of which is coupled to a voltage reference terminal, such as ground (GND). The emitter 32 of the base current compensator PNP transistor 30 is coupled in common to the base 21 of the current mirror input transistor 20 and to the base 41 of a PNP current mirror output transistor 40. The emitters 22 and 42 of current mirror transistors 20 and 40 are respectively coupled through resistors 24 and 44 to a (VCC) voltage supply rail 16, while the collector 43 of the current mirror output transistor 40 is coupled to an output terminal 45, from which an output current IOut is derived.

Although working reasonably well when operating at a designed power supply rail voltage VCC of five volts, the current mirror of FIG. 1 lacks sufficient overhead for proper circuit operation, when interfaced with a circuit (such as a differential voltage-based codec) that operates at a much lower VCC rail value (e.g., on the order of only three volts and a reference voltage $V_{REF}$ of only half that value). In addition, although the mirrored output current $I_{out}$ at the output node is first order compensated for PNP base current errors, it is not compensated for the NPN base current error in the input transistor.

More particularly, the mirrored output current $I_{out}$ at the current mirror's output terminal 45 corresponds to the collector current $I_{43}$ flowing out of the collector 43 of the current mirror output transistor 40 which, for equal geometry current mirror input and output transistors, may be defined as:

$$I_{out}=I_{43}=\alpha_{NPN10}I_{12}-2I_{12}/\beta_{PNP}^{2},$$

or $$I_{out}=I_{12}(\alpha_{NPN10}-2/\beta_{PNP}^{2}).$$

Therefore, the value of the mirrored output current $I_{out}$ may be approximated as:

$$I_{out}=I_{in}(1-1/\beta_{NPN}). \quad (1)$$

From equation (1), it can be seen that the mirrored output current $I_{out}$ at the collector 43 of the current mirror output transistor 40 not only includes the desired input current $I_{in}$, but contains an undesired base current error component $I_{in}/\beta_{NPN}$ associated with the NPN input transistor 10.

Due to the extremely tight voltage tolerances associated with the use of substantially lower VCC supply rail and reference $V_{REF}$ voltages, there is no available headroom in the collector-emitter current flow path through transistors 10–20 and the VCC supply rail for insertion of an NPN base current error compensating transistor.

As an alternative architecture, the input transistor 10 may be removed, with the input current $I_{in}$ applied directly to the collector 23 of the current mirror input transistor 20. However, this does not resolve the base current error problem, since the overhead voltage at the circuit's input port (the collector 23 of current mirror input transistor 20) is again two base-emitter diode voltage drops ($Vbe_{20}+Vbe_{30}$) below VCC.

For this alternative circuit implementation, the mirrored output current may be defined as:

$$I_{out}=I_{in}(1-1/\beta_{P}^{2}). \quad (2)$$

In accordance with the invention described in the '439 application, this base current error problem is successfully remedied by the current mirror circuit architecture shown in FIG. 2. This improved current mirror provides an overhead voltage that substantially reduces base current error, and offers a one base-emitter diode drop improvement over the overhead voltage of the conventional circuit. To this end, a bipolar PNP input current mirror transistor 50 of a current mirror input stage 200 has its base 51 coupled to the base 61 of a first bipolar PNP output current mirror transistor 60 of a first current mirror output stage 210-1 and to the base 71 of a second bipolar NPN output current mirror transistor 70 of a second current mirror output stage 210-2.

The respective emitters 52, 62 and 72 of the current mirror transistors 50, 60 and 70 are coupled (either directly of through resistors) to the power supply rail VCC. The first current mirror output transistor 60 of the first output stage 210-1 has its collector 63 coupled to a first current output port Iout_1, while the second current mirror output transistor 70 of the second output stage 210-2 has its collector 73 coupled to a second current output port Iout_2. The out put currents produced at the output currents $I_{out_1}$ and $I_{out_2}$ of respective output stages 210-1 and 210-2 are proportional to the geometry ratios of the output transistors 60 and 70 to the current mirror input transistor 50.

As in the conventional current mirror architecture of FIG. 1, the base 51 of the current mirror input transistor 50 is coupled to the emitter 82 of a base current compensator PNP transistor 80. However, rather than having its base 81 connected directly to the collector 53 of the current mirror input transistor 50, the base current compensator transistor 80 has its base coupled to the emitter 92 of an NPN base current error-reduction transistor 90. The NPN base current error-reduction transistor 90 and the base current compensator PNP transistor 80 form a buffer circuit between the current mirror and an input terminal Iin, to which the input current $I_{in}$ is coupled.

The base current error-reduction NPN transistor 90 has its base 91 coupled to the collector 53 of transistor 50 of the current mirror input stage 200, and its collector 93 is coupled to the VCC supply rail. The emitter 92 of transistor 90 is further coupled to the collector 103 of an NPN transistor 100, the base 101 of which is coupled in common with the collector and base 111 of a diode-connected current mirror reference transistor 110 of auxiliary turn-on, pull down transistor pair.

The emitter 102 of NPN transistor 100 and the emitter 112 of NPN transistor 110 are coupled to ground (AGND). The collector 113 of transistor 110 is coupled to the collector 83 of base current compensator PNP transistor 80. In addition, a diode 120 has its anode 121 coupled to the emitter 92 of NPN base current error-reduction transistor 90 and its cathode 122 coupled to the input port Iin. Diode 120 serves to ensure that the circuit turns on in the presence of a slowly ramping power supply.

An examination of the circuit of FIG. 2, in particular the circuit path through the buffer circuit transistors 80 and 90, reveals that the installation of the NPN base current error-reduction transistor 90 results in an overhead voltage Vovrhd of:

$$Vovrhd=VCC-Vbe_{PNP50}-Vbe_{PNP80}+Vbe_{NPN90}. \quad (3)$$

For equal geometries of like polarity devices, equation (3) may be rewritten as:

$$Vovrhd=VCC-2Vbe_P+Vbe_N, \quad (4)$$

which reveals at least a base-emitter diode drop larger than the overhead voltage of the conventional circuit of FIG. 1. This improvement in overhead voltage, although somewhat modest, may be of critical importance in reduced power supply rail applications (e.g., three volts or less). In addition to improving the overhead voltage, the circuit of FIG. 2 substantially reduces base current error.

Now, depending upon the application, a given current mirror architecture may be required to exhibit very large output impedances and very low power with minimal crosstalk. These requirements, when coupled with the constraint that the circuit operate at a reduced voltage supply, which may be an issue at both the input terminal and the output terminal of the current mirror, present a substantial challenge to the circuit designer.

SUMMARY OF THE INVENTION

Pursuant to the invention, this challenge is successfully addressed by an enhancement to the current mirror architecture of the above-referenced '439 application, in which the emitter area of the input stage's input current mirror transistor is used as a normalizing factor, and each output stage contains additional current circuitry that compensates for geometry differences of the respective current mirror and compensator transistors, so as to minimize crosstalk between the output stages, while dissipating minimal power. In addition, the emitter areas of transistors of the input stage are tailored in accordance with a set of current compensation relationships between the transistor circuits of the output stages and the input stage.

In order to take into account all of the current mirror drive transistors, the emitter area of the current mirror reference transistor of the auxiliary turn-on, pull down transistor pair is sized to be equal to the sum of the emitter areas of the current mirror input transistor of the current mirror input stage and all of the current mirror output transistors of the current mirror output stages. In addition, the transistor coupled in a current mirror configuration with the current mirror reference transistor has the same emitter area as the current mirror input transistor of the input stage.

Because the base current compensator PNP transistor of the current mirror s input stage's conducts the sum of the base currents of current mirror input transistor and the current mirror output transistors of all of the current mirror output stages, its emitter current is proportional to a summation of the emitter area ratios of all the current mirror stages. Likewise, the emitter current through the current mirror reference transistor may be expressed as an emitter area ratio summation current. These relationships, coupled with the fact that the base current of the base current error-reduction transistor is equal to $1/\beta^2$ times the emitter current of the input stage's current mirror transistor, make the emitter current of the input stage's current mirror input transistor proportional to $1/\alpha$ times the input current.

The current compensation circuitry of each output stage includes an additional current mirror transistor coupled in a current mirror configuration with the input stage's reference transistor. This additional current mirror transistor has the. same emitter area as the current mirror output transistor of that stage. The current mirrored at the collector of this additional transistor is reproduced by a further current mirror circuit that is summed with the mirrored collector current of the output transistor and applied to the emitter of an output port-driving transistor. The resulting output current supplied to that stage's output port is therefore equal to the summed current multiplied by the $\alpha$ of the output port-driving transistor.

The output port-driving transistor is coupled to a bias stage, that includes a pair of serially coupled, diode-connected transistors that provides a base bias of two base-emitter drops below VCC to the bases of the output port-driving transistors. The emitter-collector current flow path through these diode-connected transistors is coupled to a further transistor coupled in current mirror configuration with the reference transistor of the input stage. This further transistor has an emitter area equal to the emitter area of the reference transistor.

DETAILED DESCRIPTION

Figure 3:
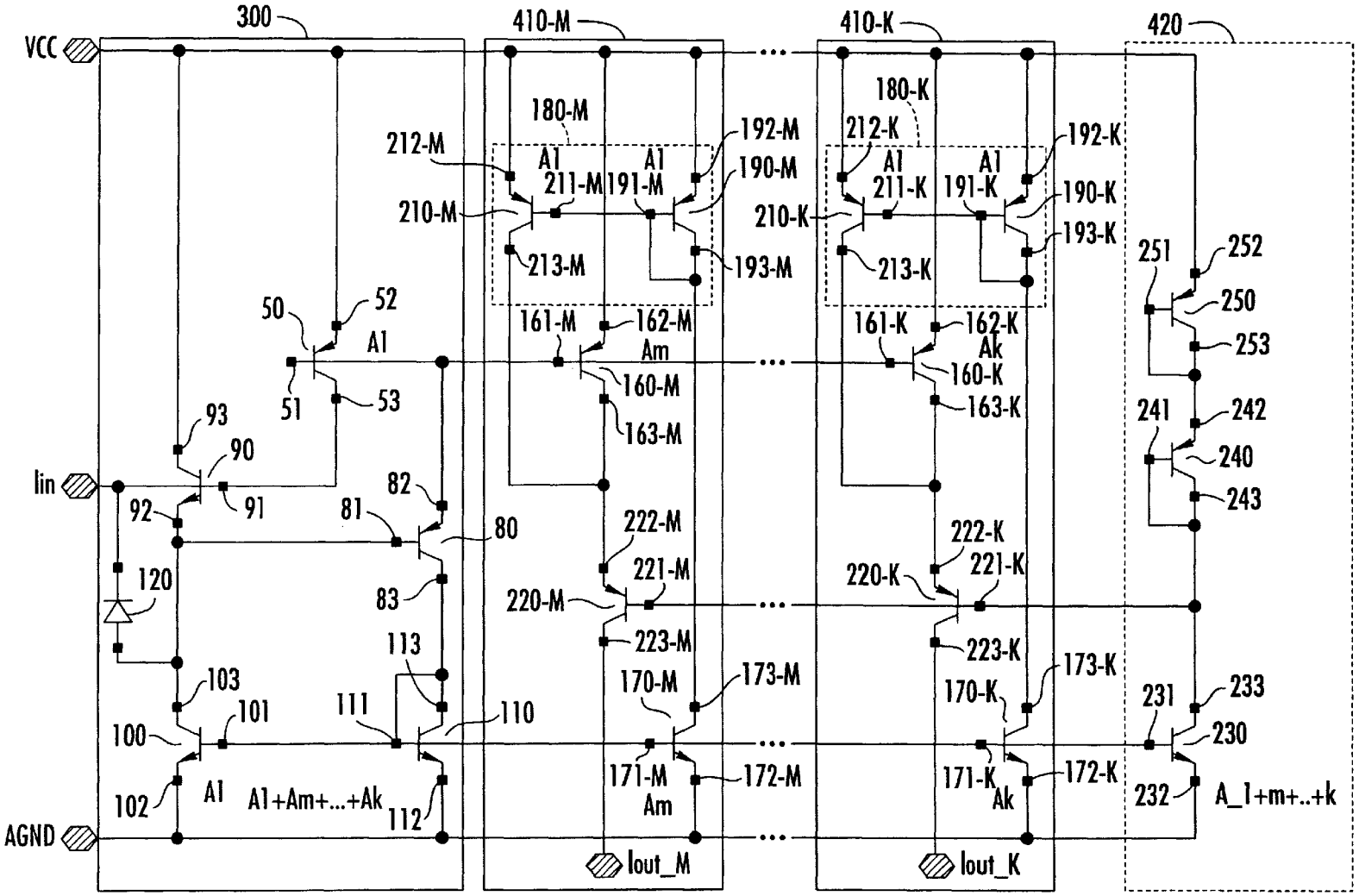
FIG. 3 is a schematic illustration of a current mirror circuit employing the base current error minimization scheme of the present invention.

Attention is now directed to FIG. 3, which schematically shows an enhancement of the current mirror circuit of the '439 application that exhibits a very high output impedance and minimum crosstalk. Although, for purposes of providing a non-limiting example, the improved current mirror architecture of FIG. 3 is configured as a PNP output current mirror transistor-based circuit, it is to be understood that the polarities of the transistors may be reversed (with an associated reversal in biasing voltage rails) without a loss in generality.

Figure 1:
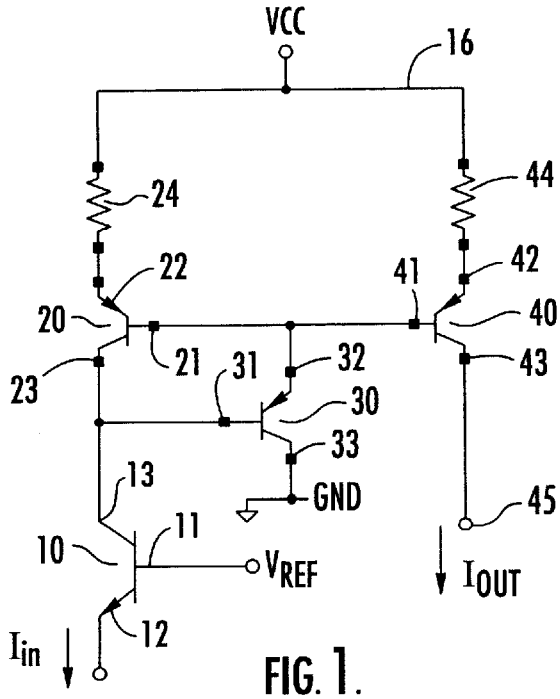
FIG. 1. (PRIOR ART)
FIG. 1 is a schematic illustration of a conventional current mirror circuit in which the mirrored output current is first order compensated for PNP base current errors.
Figure 2:
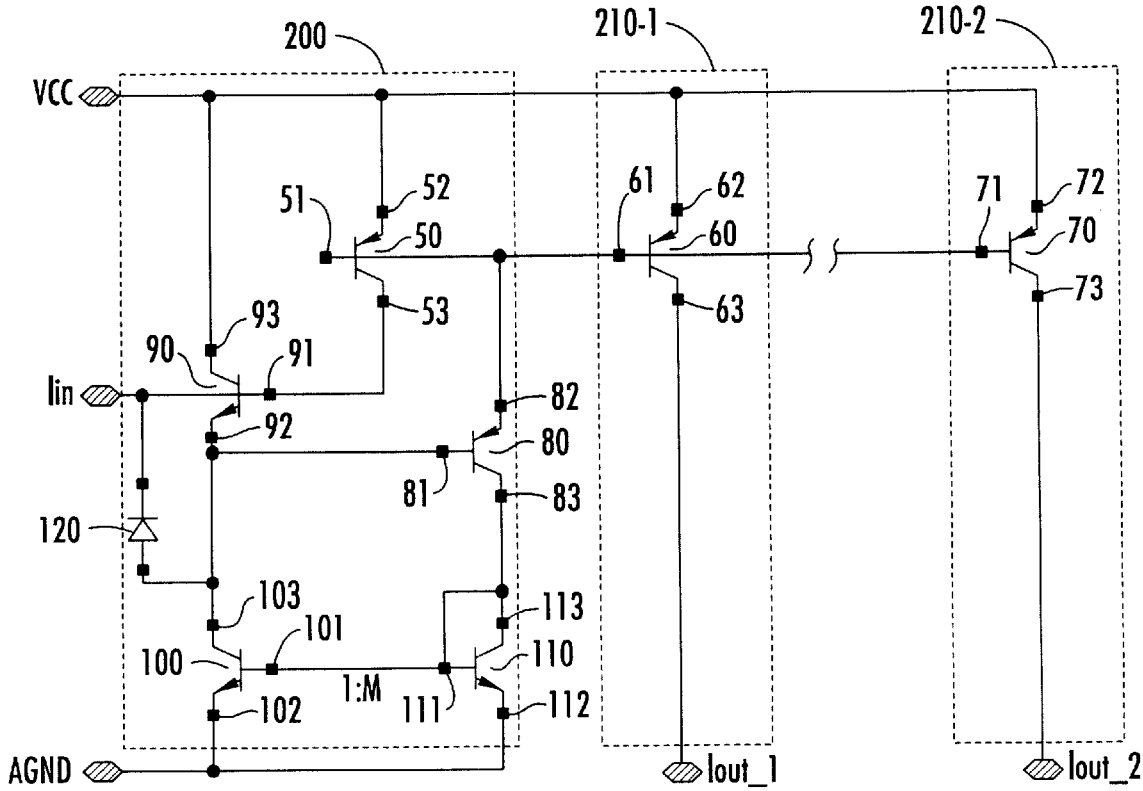
FIG. 2 is a schematic illustration of a current mirror circuit employing the base current error minimization scheme of the invention described in the '439 application.

Similar to the current mirror configuration of FIG. 2, described above, the enhanced circuit of FIG. 3 is shown as having an input stage 300 coupled to a current input port Iin. Except for differences in geometries (emitter areas) of the transistors 100 and 110, the circuit configuration of the input stage 300 of FIG. 3 is schematically the same as that of the input stage 200 of the circuit architecture of FIG. 2. However, as will be described, the geometries of these transistors are tailored in accordance with a set of current compensation relationships between the transistor circuits of the output stages and the input stage, such that a respective output stage current $I_{out_i}$ may be defined in accordance with a prescribed current mirror ratio factor for that stage.

The input stage's bipolar PNP input current mirror transistor 50 (having a first emitter area A1 employed as a normalizing factor, as will be described) has its base 51 coupled to the bases of bipolar PNP output current mirror transistors of all of its output. stages, an arbitrary pair of which are surrounded by broken lines 410-M and 410-K. It is to be understood, that the invention is not limited to only two output stages, but is expected to be employed with a plurality of N output stages. Only two stages are shown in order to reduce the complexity of the drawings and the descriptive text (including operational equations) associated therewith.

For the embodiment of FIG. 3 having a pair of output stages 410-M and 410-K, the base 51 of the input stage current mirror input transistor 50 is coupled to the base 161-M of a bipolar PNP output current mirror transistor 160-M of the Mth current mirror output stage 410-M and to the base 161-K of a bipolar NPN output current mirror transistor 160-K of the Kth current mirror output stage 410-K. The respective emitters 52, 162-M and 162-K of transistors 50, 160-M and 160-K are coupled (either directly or through resistors, not shown) to power supply rail VCC.

As in the current mirror architecture of FIG. 2, the base current compensator PNP transistor 80 of the input stage 300 conducts the sum of the base currents from the current mirror input transistor 50 and the current mirror output transistors of the plurality of current mirror-output stages 410. As noted above, the emitter area of an arbitrary output stage's current mirror output transistor 160-*i* is defined in accordance with the desired ratio between that stage's mirrored output current $I_{out_i}$ and the input current $I_{in}$. For example, the ratio between the mirrored output current $I_{out_k}$ at the output port $I_{out}$—K of current mirror output stage 410-K and the input current $I_{in}$ at the current mirror's input port Iin to the input stage 300 is Ak/A1.

In order to take into account all of the current mirror drive transistors, the emitter area A110 of transistor 110 is sized to be equal to the sum of all of the emitter areas A1+Am+ . . . +Ak (namely, the emitter areas of all of the current mirror transistors including the current mirror input transistor 50 of the current mirror input stage 300 and all of the current mirror output transistors 160 of the current mirror output stages 410). In addition, transistor 100, which is coupled in a current mirror configuration with transistor 110, has an emitter area A1 that corresponds to that of the current mirror input transistor 50, and is operative to bias the transistor base current error-reduction. transistor 90, such that the current error is proportional to $1/\beta_N\beta_P$, and is therefore negligible.

More particularly, as pointed out above, the input stage's base current compensator PNP transistor 80 conducts the sum of the base currents of current mirror input transistor 50 and the current mirror output transistors of the current mirror output stages 410. Thus, the emitter current $Ie_{80}$ of base current compensator transistor 80 may be defined as:

$$\begin{aligned} Ie_{80} &= (Ie_{50} + Ie_{160-M} + \ldots + Ie_{160-K})/(\beta_P + 1) \\ &= Ie_{50}(1 + M + \ldots + K)(\beta_P + 1). \end{aligned} \tag{5}$$

As can be seen from equation (5) the emitter current $Ie_{80}$ of transistor 80 is proportional to a summation of the emitter area ratios of all the current mirror stages.

Similarly, the emitter current $Ie_{100}$ through transistor 100 may be defined as an emitter area ratio summation current as:

$Ie_{100}=Ie_{110}*1/(1+M+ \ldots +K)$, which may be approximated as:

$$\approx Ie_{80}/(1+M+ \ldots +K)=Ie_{50}/(\beta_P+1). \tag{6}$$

The base current $Ib_{90}$ of the base current error-reduction transistor 90 may be approximated by:

$$Ib_{90}=Ie_{100}/(\beta_N+1)=>Ib_{90}\approx Ie_{50}/(\beta_N\beta_P). \tag{7}$$

From these relationships, it can be seen that:

$$I_{in}+Ib_{90}=Ic_{50}=\alpha_P*Ie_{50}=>I_{in}=Ie_{50}(\alpha_P-1/\beta_N\beta_P). \tag{8}$$

Namely, $I_{in}$ may be approximated as:

$$I_{in}=\alpha_P Ie_{50}. \tag{9}$$

Rewriting equation (9) for the emitter current $Ie_{50}$ of the input stage's current mirror input transistor 50 yields:

$$Ie_{50}\approx I_{in}/\alpha_P, \tag{10}$$

as desired.

In accordance with the invention, each output stage 410-*i* contains additional current compensation circuitry which serves to take into account the geometry differences of the respective transistors, and effectively insure minimal crosstalk between any of the output stages. This compensation circuitry includes an NPN current mirror transistor 170-*i* coupled in a current mirror configuration with the input stage's NPN transistor 110. NPN current mirror transistor 170-*i* has an associated emitter area Ai that corresponds to that of the emitter area Ai of the PNP current mirror output transistor 160-*i* of that stage. The current mirrored at the collector 173-*i* of transistor 170-*i* is reproduced by a further PNP current mirror circuit 180-*i*, comprised of a diode-connected PNP transistor 190-*i* and an associated current mirror transistor 210-*i*.

The collector 213-*i* of the current mirror transistor 210-*i* is coupled in common with the collector 163-*i* of the current mirror transistor 160-*i* and the emitter 222-*i* of an output port-driving PNP transistor 220-*i*. As a result, the mirrored current $I_{213-i}$ at the collector 213-*i* of the current mirror transistor 210-*i* is summed with the mirrored collector current $I_{163-i}$ at the emitter 222-*i* of the output port-driving PNP transistor 220-*i*. The resulting output current $I_{out_i}$ supplied to the output port Iout_i by the collector 223-*i* of transistor 220 is therefore equal to the summed current multiplied by the $\alpha_{P220-i}$ of the output port driving transistor 220.

In order to facilitate an understanding of the operation of the modified circuit architecture of FIG. 3, the functionality of an individual output stage 410-K will now be described.

The current $Ie_{170-K}$ at the emitter 172-K of the current mirror transistor 170-K of the output stage 410-K may be defined as:

$$Ie_{170-K}=K/(1+M+\ldots+K)*Ie_{110}. \quad (11)$$

With transistor 110 being coupled in circuit with transistor 80, the current $Ie_{170-K}$ may be approximated in terms of the emitter current $Ie_{80}$ through transistor 80 as:

$$Ie_{170-K}\approx Ie_{80}*K/(1+M+\ldots+K). \quad (12)$$

Using equation (5), equation (12) may be rewritten as:

$$Ie_{170-K}\approx\{K/(1+M+\ldots+K)\}*\{(Ie_{50})(1+M+\ldots+K)/(\beta_p 1)\}. \quad (13)$$

Because the emitter area summation terms cancel in equation (13), the emitter current $Ie_{170-K}$ through the current mirror transistor 170-K may be approximated as:

$$Ie_{170-K}\approx KIe_{50}/(\beta_P+1). \quad (14)$$

Now, the current $Ie_{220-K}$ flowing into the emitter 222-K of the output port driving transistor 220-K may be defined as:

$Ie_{220-K}=\alpha_{P160-K}*Ie_{160-K}+Ic_{210-K}$, which may be approximated as:

$$Ie_{220-K}\approx\alpha_P KIe_{50}+Ie_{170-K},$$

or $$Ie_{220-K}\approx\alpha_P KIe_{50}+KIe_{50}/(\beta_P+1). \quad (15)$$

Using equation (10) for the expression for the emitter current $Ie_{50}$ of the current mirror transistor 50 of the input stage 300, the emitter current $Ie_{220-K}$ may be written as:

$$\begin{aligned} Ie_{220-K} &\approx KI_{in}+K(I_{in}/\alpha_P)/(\beta_P+1) \quad (16)\\ &\approx KI_{in}*\{1+((\beta_P+1)/\beta_P)/(\beta_P+1)\}, \text{ or}\\ &\approx KI_{in}*(1+1/\beta_P). \end{aligned}$$

The output current $I_{out_K}$ at output port Iout_K is therefore definable as:

$$I_{out_K}=\alpha_P Ie_{220-K}=KI_{in}*\{(\beta_P+1)/\beta_P\}*\{\beta_P/(\beta_P+1)\},$$

or $$I_{out_K}=KI_{in}. \quad (17)$$

The modified current mirror architecture of FIG. 3 also includes a bias stage 420. Bias stage 420 is comprised of an NPN transistor 230 having its emitter 232 coupled to AGND, its base 231 coupled to the bases of transistors 110 and 170-*i* and its collector 233 coupled to the bases of transistors 220-*i* and to the common connection of the collector 243 and base 241 of diode-connected PNP transistor 240. Transistor 230 has an emitter area A230 equal to the emitter area A110 of transistor 110 which, as noted above, is the sum of the emitter areas (A1+Am+ . . . +Ak). The diode-connected PNP transistor 240 has its emitter 242 coupled to the common connected collector 253 and base 251 of diode-connected PNP transistor 250, and its emitter 252 coupled to VCC. The series connection of diode-connected transistors 240 and 250 provides a base bias of two base-emitter drops below VCC to the bases of the output port-driving transistors 220-*i*.

As will be appreciated from the foregoing description, the present invention provides a modification of the current mirror architecture of the above-referenced '439 application, in which, using the emitter area of the input stage's input current mirror transistor as a normalizing factor, each output stage is augmented to include additional circuitry that compensates for geometry differences of the respective current mirror transistors, minimizes crosstalk between the output stages and consumes minimal power. In addition, the emitter areas of transistors of the input stage are tailored in accordance with a set of current compensation relationships between the transistor circuits of the output stages and the input stage.

While I have shown and described an embodiment in accordance with the present invention, it is to be understood that the same is not limited thereto but is susceptible to numerous change s and modifications as known to a person skilled in the art. I therefore do not wish to be limited to the details shown and described herein, but intend to cover all changes and modifications as are obvious to one of ordinary skill in the art.

What is claimed is:

1. A current mirror circuit comprising:

an input stage having an input port adapted to receive an input current, and a plurality of output stages coupled to said input stage and having output ports adapted to provide respective output currents in accordance with said input current, said input stage including a current mirror input transistor coupled to associated current mirror output transistors of said plurality of output stages, a buffer circuit having a control voltage compensation transistor coupled to said current mirror input transistor and said current mirror output transistors, and a current error-reduction transistor coupled in circuit with said control voltage compensation transistor and said current mirror input transistor, and an auxiliary turn-on current mirror circuit coupled with said buffer circuit; and a respective one of said plurality of output stages includes an output stage compensation circuit having a compensation current mirror transistor coupled between a current mirror output transistor and an output port of said respective one of said plurality of output stages, and coupled in a current mirror configuration with said auxiliary turn-on current mirror circuit.

2. The current mirror circuit according to claim 1, wherein said auxiliary turn-on current mirror circuit includes a reference transistor having a prescribed geometry relationship with said current mirror input transistor of said input stage and current mirror output transistors of said output stages.

3. The current mirror circuit according to claim 2, wherein said reference transistor has a geometry corresponding to the sum of associated geometries of said current mirror input transistor of said input stage and current mirror output transistors of said output stages.

4. The current mirror circuit according to claim 3, wherein said compensation current mirror transistor and said current mirror output transistor of said output stage have the same geometry relationship with said reference transistor of said auxiliary turn-on current mirror circuit.

5. The current mirror circuit according to claim 2, wherein said respective one of said output stages includes an additional current mirror circuit coupled to said compensation current mirror transistor and being adapted to supply a mirrored current that is summed with current of said current mirror output transistor and coupled to said output port.

6. The current mirror circuit according to claim 5, further including an output port-driving transistor coupled between said output port and said additional current mirror circuit, and being operative to supply an output current to said output port in accordance with the mirrored current that is summed with current of said current mirror output transistor.

7. The current mirror circuit according to claim 1, further including a bias stage, coupled to a power supply terminal and a reference voltage terminal, and being operative to couple a prescribed bias voltage to said compensation current mirror transistor of said output stage compensation circuit, and wherein said auxiliary turn-on current mirror circuit includes a reference transistor having a prescribed geometry relationship with said current mirror input transistor of said input stage and said current mirror output transistors of said output stages, and wherein said bias stage includes a bias transistor coupled in current mirror configuration with and having the same geometry as said reference transistor.

8. A current mirror circuit comprising:

an input stage having an input port adapted to receive an input current, a current mirror input transistor having an input electrode coupled to said input port, an output electrode coupled to a power supply terminal, and a control electrode, a first compensation transistor having an input electrode coupled to said control electrode of said current mirror input transistor, an output electrode, and a control electrode coupled to an output electrode of a second compensation transistor, said second compensation transistor having an input electrode coupled to said power supply terminal, a control electrode coupled to said output electrode of said current mirror input transistor, and an output electrode, and an auxiliary turn-on circuit comprised of two transistors in current mirror configuration, and coupled between a reference voltage terminal and said first and second compensation transistors; and a plurality of output stages, a respective one of which includes an output port adapted to provide an output current therefrom, a current mirror output transistor having an input electrode coupled to said power supply terminal, an output electrode coupled to said output port, and a control electrode coupled to said control electrode of said current mirror input transistor, and being operative to provide a current to said output port in accordance with said input current, and an output stage compensation circuit including a further current mirror transistor coupled in a current mirror configuration with said transistors of said auxiliary turn-on circuit of said input stage.

9. The current mirror circuit according to claim 8, wherein said auxiliary turn-on circuit includes a reference transistor having a prescribed geometry relationship with said current mirror input transistor of said input stage and said current mirror output transistors of said output stages.

10. The current mirror circuit according to claim 9, wherein said reference transistor has a prescribed geometry that corresponds to the sum of associated geometries of said current mirror input transistor of said input stage and said current mirror output transistors of said output stages.

11. The current mirror circuit according to claim 10, wherein said input electrode of said first compensation transistor is coupled to receive a summation of control electrode currents of said current mirror input transistor and said current mirror output transistors of said output stages.

12. The current mirror circuit according to claim 9, wherein said further current mirror transistor and said current mirror output transistor of said output stage have the same geometry relationship with said reference transistor of said auxiliary turn-on circuit.

13. The current mirror circuit according to claim 9, wherein said respective one of said output stages includes an additional current mirror circuit coupled to said further current mirror transistor and supplying a mirrored current that is summed with current of said current mirror output transistor and coupled to said output port.

14. The current mirror circuit according to claim 13, further including an outputs port-driving transistor coupled between said output port and said additional current mirror circuit, and being operative to supply an output current to said output port in accordance with the mirrored current that is summed with current of said current mirror output transistor.

15. The current mirror circuit according to claim 8, further including a bias stage, coupled to said power supply terminal and said reference voltage terminal, and being operative to couple a prescribed bias voltage to said further current mirror transistor of said output stage compensation circuit.

16. The current mirror circuit according to claim 15, wherein said auxiliary turn-on circuit includes a reference transistor having a geometry relationship with said current mirror input transistor of said input stage and said current mirror output transistors of said output stages, and wherein said bias stage includes a bias transistor coupled in current mirror configuration with and having the same geometry as said reference transistor of said input stage.

17. The current mirror circuit according to claim 8, wherein said auxiliary turn-on circuit further includes a diode coupled in circuit with said input port and said first and second compensation transistors.

18. The current mirror circuit according to claim 8, wherein said current mirror circuit is configured of bipolar transistors.

19. The current mirror circuit according to claim 8, wherein said current mirror input and output transistors have a polarity opposite, to that of said further current mirror transistor of a respective output stage and transistors of said auxiliary turn-on circuit of said input stage.

20. The current mirror circuit according to claim 13, wherein transistors of said additional current mirror circuit have a geometry corresponding to that of said input current mirror transistor of said input stage.

* * * * *